US005957356A

United States Patent [19]

Potempa

[11] Patent Number: 5,957,356

[45] Date of Patent: Sep. 28, 1999

[54] AIR SUPPORT APPARATUS

[76] Inventor: Daryl Potempa, 11128 S. 84th Ave., Palos Hills, Ill. 60465

[21] Appl. No.: 09/044,328

[22] Filed: Mar. 19, 1998

Related U.S. Application Data

[63] Continuation-in-part of application No. 08/762,273, Dec. 9, 1996, abandoned.

[51] Int. Cl.[6] ..... A45F 3/04; A45F 3/12; A45F 3/14

[52] U.S. Cl. ..... 224/643; 224/259; 224/264; 224/644

[58] Field of Search ..... 224/259, 642, 224/643, 644, 264, 907

[56] References Cited

U.S. PATENT DOCUMENTS

| | | | |
|---|---|---|---|
| 900,610 | 10/1908 | Stow | 224/264 |
| 3,679,108 | 7/1972 | Ingram | 224/644 |
| 4,384,602 | 5/1983 | Ores | 224/642 |
| 4,420,103 | 12/1983 | Douglass | 224/907 |
| 4,830,245 | 5/1989 | Arakaki | 224/907 |
| 4,981,110 | 1/1991 | Llewellyn | 224/264 |
| 5,573,155 | 11/1996 | Sadler | 224/907 |
| 5,632,429 | 5/1997 | Cantwell | 224/644 |

FOREIGN PATENT DOCUMENTS

| | | | |
|---|---|---|---|
| 2754061 | 6/1979 | Germany | 224/907 |

*Primary Examiner*—Stephen P. Garbe

[57] ABSTRACT

A new air support apparatus for use in a variety of applications including providing support to a structure. The inventive device includes an inflatable tube, a valve for permitting inflation of the inflatable tube, and a flexible mesh in a surrounding relationship with the inflatable tube such that the mesh constrains the shape of the inflatable tube upon its inflation.

3 Claims, 3 Drawing Sheets

AIR SUPPORT APPARATUS

CROSS REFERENCE TO RELATED APPLICATION

This application is a continuation-in-part of my prior utility patent application Ser. No. 08/762,273, filed Dec. 9, 1996, now abandoned.

BACKGROUND OF THE INVENTION

1. Field of the Invention

The present invention relates to inflatable support structures and more particularly pertains to a new air support apparatus for use in a variety of applications including providing support to a structure.

2. Description of the Prior Art

The use of inflatable support structures is known in the prior art. More specifically, inflatable support structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art inflatable support structures include U.S. Pat. No. 4,901,481; U.S. Pat. No. 5,007,212; U.S. Pat. No. 5,005,322; U.S. Pat. No. Des. 352,328; and U.S. Pat. No. Des. 302,720.

While these devices fulfill their respective, particular objectives and requirements, the aforementioned patents do not disclose a new air support apparatus. The inventive device includes an inflatable tube, a valve for permitting inflation of the inflatable tube, and a flexible mesh in a surrounding relationship with the inflatable tube such that the mesh constrains the shape of the inflatable tube upon its inflation.

In these respects, the air support apparatus according to the present invention substantially departs from the conventional concepts and designs of the prior art, and in so doing provides an apparatus primarily developed for the purpose of use in a variety of applications including providing support to a structure.

SUMMARY OF THE INVENTION

In view of the foregoing disadvantages inherent in the known types of inflatable support structures now present in the prior art, the present invention provides a new air support apparatus construction wherein the same can be utilized for use in a variety of applications including providing support to a structure.

The general purpose of the present invention, which will be described subsequently in greater detail, is to provide a new air support apparatus apparatus and method which has many of the advantages of the inflatable support structures mentioned heretofore and many novel features that result in a new air support apparatus which is not anticipated, rendered obvious, suggested, or even implied by any of the prior art inflatable support structures, either alone or in any combination thereof.

To attain this, the present invention generally comprises an inflatable tube, a valve for permitting inflation of the inflatable tube, and a flexible mesh in a surrounding relationship with the inflatable tube such that the mesh constrains the shape of the inflatable tube upon its inflation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new air support apparatus apparatus and method which has many of the advantages of the inflatable support structures mentioned heretofore and many novel features that result in a new air support apparatus which is not anticipated, rendered obvious, suggested, or even implied by any of the prior art inflatable support structures, either alone or in any combination thereof.

It is another object of the present invention to provide a new air support apparatus which may be easily and efficiently manufactured and marketed.

It is a further object of the present invention to provide a new air support apparatus which is of a durable and reliable construction.

An even further object of the present invention is to provide a new air support apparatus which is susceptible of a low cost of manufacture with regard to both materials and labor, and which accordingly is then susceptible of low prices of sale to the consuming public, thereby making such air support apparatus economically available to the buying public.

Still yet another object of the present invention is to provide a new air support apparatus which provides in the apparatuses and methods of the prior art some of the advantages thereof, while simultaneously overcoming some of the disadvantages normally associated therewith.

Still another object of the present invention is to provide a new air support apparatus for use in a variety of applications including providing support to a structure.

Yet another object of the present invention is to provide a new air support apparatus which includes an inflatable tube, a valve for permitting inflation of the inflatable tube, and a flexible mesh in a surrounding relationship with the inflatable tube such that the mesh constrains the shape of the inflatable tube upon its inflation.

Still yet another object of the present invention is to provide a new air support apparatus that provides structure.

Even still another object of the present invention is to provide a new air support apparatus that is easily folded for convenient storage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
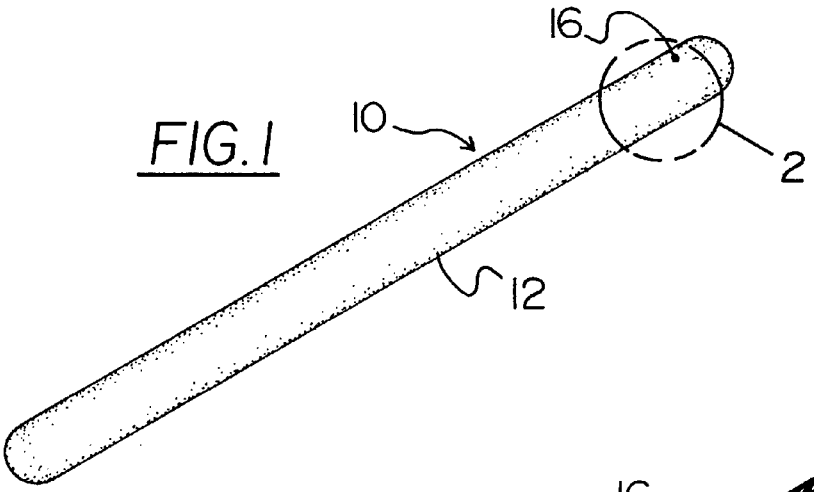
FIG. 1 is a plan view of a new Air Support Apparatus according to the present invention.
Figure 2:
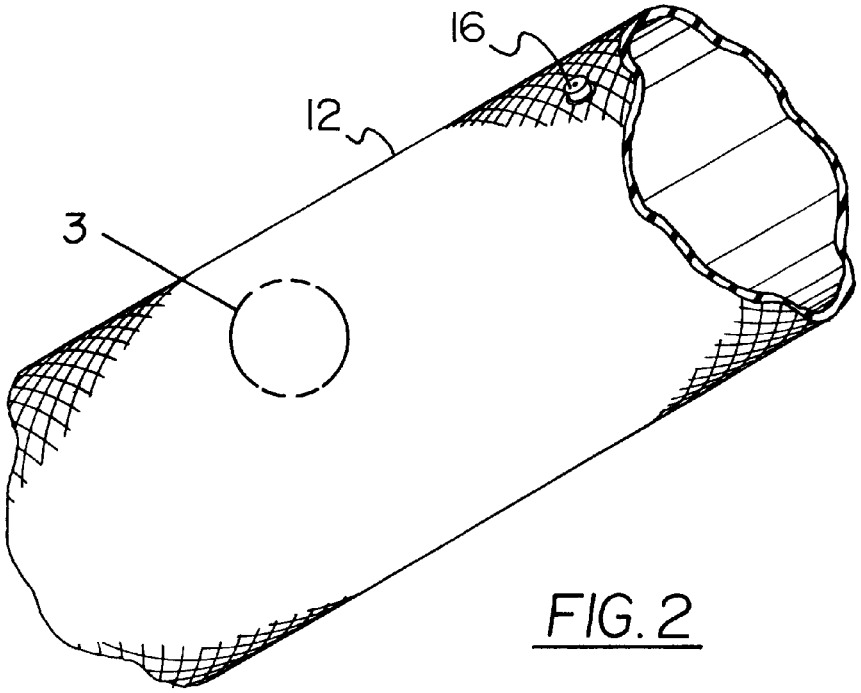
FIG. 2 is a fragmented view thereof showing the air valve.
Figure 3:
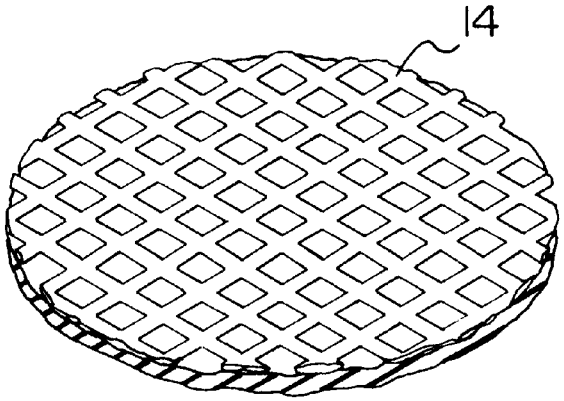
FIG. 3 is an fragmented view of the present invention showing the flexible mesh.
Figure 4:
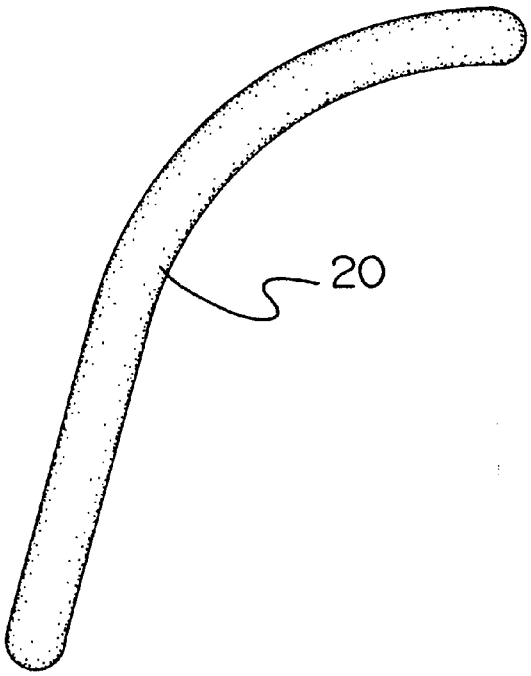
FIG. 4 is a plan view of the invention showing a curved tube.

With reference now to the drawings, and in particular to FIGS. 1 through 8 thereof, a new Air Support Apparatus embodying the principles and concepts of the present invention and generally designated by the reference numeral 10 will be described.

More specifically, it will be noted that the Air Support Apparatus 10 comprises an inflatable tube 12, a flexible mesh 14 in surrounding relationship with the inflatable tube 12 and a means for inflating the inflatable tube 16.

Figure 5:
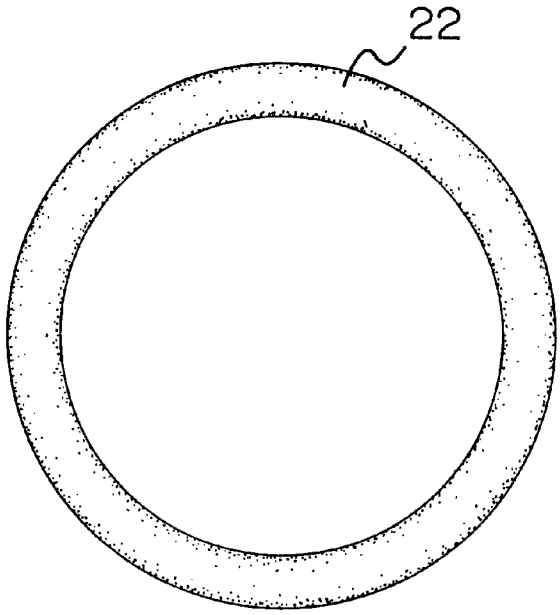
FIG. 5 is a plan view of the invention showing a circular tube.

As best illustrated in FIGS. 1 through 8, it can be shown that the inflatable tube 12, which can be fabricated of rubber or any other suitable material, is surrounded by the flexible mesh 14. The flexible mesh 14 is of strong construction and can be made of any suitable material such as nylon, polyester or rayon. Air enters the inflatable tube 12 by way of the means for inflating the inflatable tube 16, which can include an air valve, and the inflatable tube 12 takes on the shape provided by the flexible mesh 14. Useful shapes include tubes of all shapes such as a curved tube 20 (FIG. 4) and a ring 22 (FIG. 5).

Figure 6:
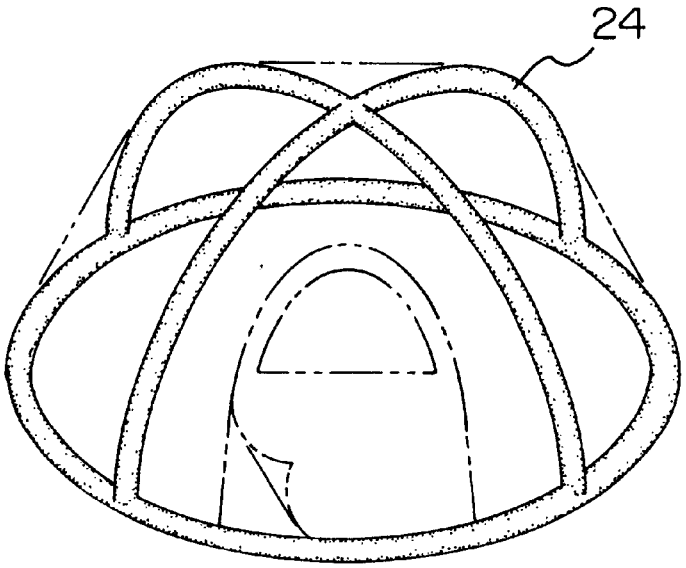
FIG. 6 is a perspective view of the invention showing a support structure for a tent.
Figure 7:
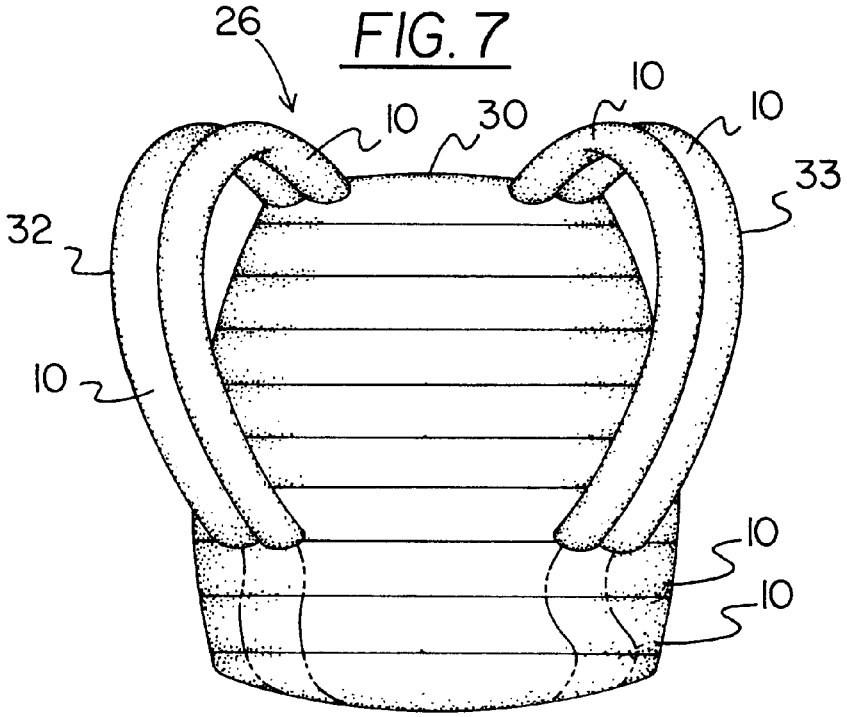
FIG. 7 is a perspective view of the invention showing a support structure for a back pack.
Figure 8:
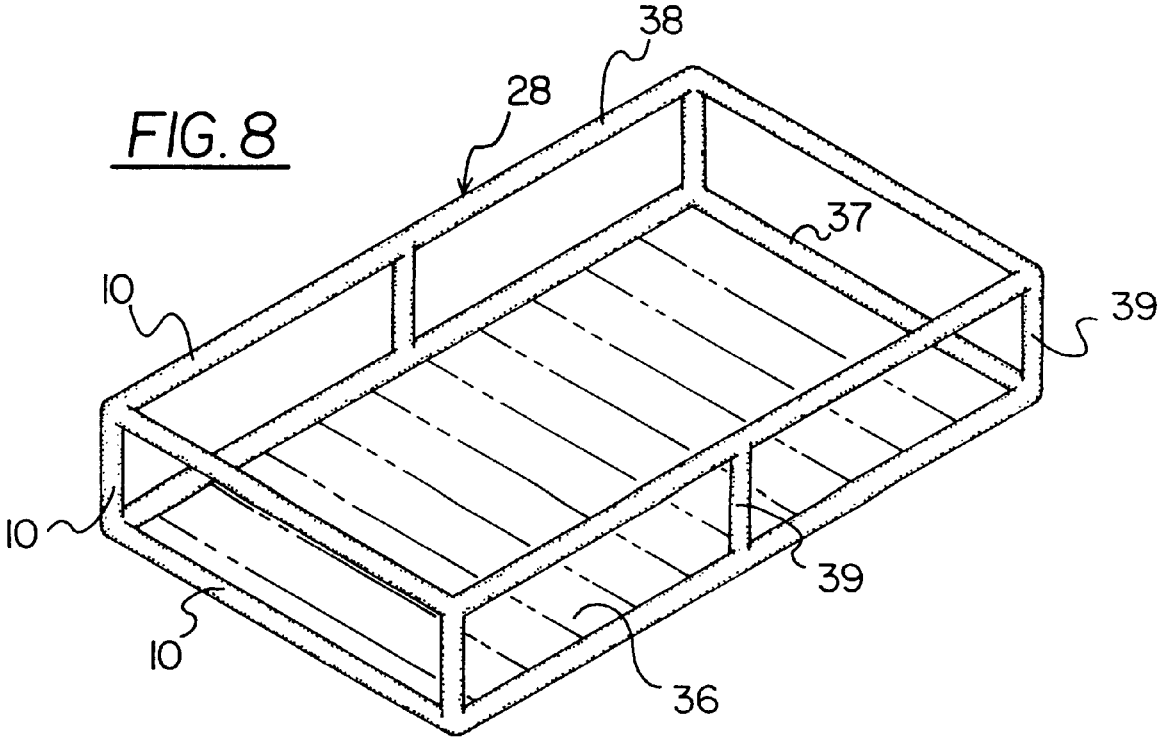
FIG. 8 is a perspective view of the invention showing a child's play pen structure.

As best illustrated in FIGS. 6–8, the Air Support Apparatus 10 can be used to provide support for a structure such as a tent 24 (FIG. 6) or a back pack 26 (FIG. 7) or provide structure itself as for a child's play pen 28 (FIG. 8).

In use, the inflatable tube 12 is inflated by means of air valve 16. Upon inflation the inflatable tube 12 takes on the shape of the flexible mesh 14 and can be used as a support for a structure or as a structure in and of itself.

With particular reference to FIG. 7, the air support backpack support harness assembly 26 comprises an inflatable back support 30 which is attachable to a bag for carrying on a back. The inflatable back support 30 comprising a plurality of elongate inflatable structures 10 which are arranged in a laterally adjacent series. The support harness assembly 26 also includes a pair of spaced apart inflatable shoulder straps 32, 33. Each of the inflatable shoulder strap has upper and lower ends which are coupled to the inflatable back support 30. Preferably, each of the inflatable shoulder straps 32, 33 comprises a pair of elongate inflatable structures 10 which are arranged in a laterally adjacent series. As mentioned previously, each inflatable structure includes 10, an elongate inflatable tube 12, a flexible mesh 14 surrounding the inflatable tube, and an inflation means 16 for inflating the inflatable tube. Preferably, the inflation means includes a valve which is extended through the inflatable member 12 to provide a selectably closable opening into the interior of the inflatable member 12 to permit inflation and deflation of the inflatable member 12.

With closer reference to FIG. 8, the air support playpen apparatus 28 comprises a generally rectangular floor structure 36 having an outer perimeter. A rectangular lower inflatable rail structure 37 is extended around said outer perimeter of the floor structure 36. A rectangular upper inflatable rail structure 38 is positioned above the lower inflatable guide rail structure 37. The upper inflatable rail structure 38 is spaced apart from the lower inflatable guide rail structure 37. The upper inflatable rail structure 38 is also is aligned with the outer perimeter of the floor structure 36. A plurality of spaced apart inflatable support rail structures 39 are extended between the lower inflatable rail structure 37 and the upper inflatable rail structure 38. Ideally, the floor structure also is inflatable. Like the other devices, the lower inflatable rail structure 37, the upper inflatable rail structure 38, and the inflatable support rail structures 39 all comprise the air support apparatus It) having an elongate inflatable tube 12, an inflation means for inflating the inflatable tube 16, and a flexible mesh 14 surrounding the lower inflatable rail structure, the upper inflatable rail structure, and the inflatable support rail structures. Preferably, like the other structures, each the inflation means includes a valve extending through the inflatable member to provide a selectably closable opening into the interior of the inflatable member to permit inflation and deflation of the inflatable member. In the preferred embodiment of the air support playpen apparatus 28 a flexible mesh 14 surrounds each inflatable tube 12 separately.

With regards to the air support playpen apparatus 28, preferably, of a inflatable support rail structure 39 is extended between the upper inflatable rail structure 38 and the lower inflatable rail structure 37 at each corresponding corner of the upper inflatable rail structure and the lower inflatable rail structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An air cushioned backpack support assembly, comprising:

an inflatable back support for carrying in a position adjacent a back of a user; and a pair of spaced apart inflatable shoulder straps, each of said inflatable shoulder straps having upper and lower ends being mounted to said inflatable back support for forming a loop with said back support for receiving a shoulder of a user;

wherein said inflatable back support has an upper end and a lower end and side edges extending between the upper and lower ends, said side edges being arcuate with a middle portion bulging laterally outward, said back support comprising:

a plurality of elongate inflatable tubular members extending laterally in a parallel orientation such that the entire back support is formed from said inflatable tubular members for cushioning the weight of a backpack against the back of a wearer;

a flexible mesh surrounding said inflatable members; and an inflation means for inflating said inflatable members;

wherein each of said inflatable shoulder straps comprises:

a pair of elongate inflatable tubular members extending in parallel in a longitudinal direction, said inflatable members of the shoulder straps being mounted at one end to the upper end of said back support, and an opposite end of the inflatable members of the shoulder straps being mounted to said back support at a location spaced upward from the lower end of said back support;

a flexible mesh surrounding said inflatable members; and an inflation means for inflating said inflatable members.

2. The air support backpack support harness of claim 1, wherein said flexible mesh constrains the shape taken by said inflatable member when said inflatable member is inflated.

3. The air support backpack support harness of claim 1, wherein said inflation means includes a valve, said valve being extended through said inflatable member to provide a selectably closable opening into the interior of said inflatable member to permit inflation and deflation of said inflatable member.

* * * * *